US007214278B2

(12) United States Patent
Kusinski et al.

(10) Patent No.: US 7,214,278 B2
(45) Date of Patent: May 8, 2007

(54) HIGH-STRENGTH FOUR-PHASE STEEL ALLOYS

(75) Inventors: Grzegorz J. Kusinski, Irvine, CA (US); Gareth Thomas, Cassis (FR)

(73) Assignee: MMFX Technologies Corporation, Irvine, CA (US)

( * ) Notice: Subject to any disclaimer, the term of this patent is extended or adjusted under 35 U.S.C. 154(b) by 115 days.

(21) Appl. No.: 11/027,334

(22) Filed: Dec. 29, 2004

(65) Prior Publication Data

US 2006/0137781 A1 Jun. 29, 2006

(51) Int. Cl.
*C22C 38/18* (2006.01)
*C21D 9/00* (2006.01)

(52) U.S. Cl. ..... 148/333; 148/325; 148/660; 148/664

(58) Field of Classification Search ..... 148/333, 148/325, 660, 664, 637, 579
See application file for complete search history.

(56) References Cited

U.S. PATENT DOCUMENTS 4,170,497 A 10/1979 Thomas et al.
4,170,499 A 10/1979 Thomas et al.
4,619,714 A 10/1986 Thomas et al.
4,671,827 A 6/1987 Thomas et al.
5,520,718 A 5/1996 Keilman et al.
5,653,826 A * 8/1997 Koo et al. ..... 148/328
6,273,968 B1 8/2001 Thomas
6,709,534 B2 3/2004 Kusinski et al.
6,746,548 B2 6/2004 Kusinski et al.

FOREIGN PATENT DOCUMENTS

JP 2004244691 * 9/2004
WO WO 2004/046400 A1 6/2004

* cited by examiner

*Primary Examiner*—Deborah Yee
(74) *Attorney, Agent, or Firm*—Townsend and Townsend and Crew LLP.; Henry Heines

(57) ABSTRACT

A carbon steel alloy that exhibits the combined properties of high strength, ductility, and corrosion resistance is one whose microstructure contains ferrite regions combined with martensite-austenite regions, with carbide precipitates dispersed in the ferrite regions but without carbide precipitates are any of the interfaces between different phases. The microstructure thus contains of four distinct phases: (1) martensite laths separated by (2) thin films of retained austenite, plus (3) ferrite regions containing (4) carbide precipitates. In certain embodiments, the microstructure further contains carbide-free ferrite regions.

16 Claims, 5 Drawing Sheets

HIGH-STRENGTH FOUR-PHASE STEEL ALLOYS

BACKGROUND OF THE INVENTION

1. Field of the Invention

This invention resides in the field of steel alloys, particularly those of high strength, toughness, corrosion resistance, and ductility, and also in the technology of the processing of steel alloys to form microstructures that provide the steel with particular physical and chemical properties.

2. Description of the Prior Art

Steel alloys of high strength and toughness whose microstructures are composites of martensite and austenite phases are disclosed in the following United States patents and published international patent application, each of which is incorporated herein by reference in its entirety:

- U.S. Pat. No. 4,170,497 (Gareth Thomas and Bangaru V. N. Rao), issued Oct. 9, 1979 on an application filed Aug. 24, 1977
- U.S. Pat. No. 4,170,499 (Gareth Thomas and Bangaru V. N. Rao), issued Oct. 9, 1979 on an application filed Sep. 14, 1978 as a continuation-in-part of the above application filed on Aug. 24, 1977
- U.S. Pat. No. 4,619,714 (Gareth Thomas, Jae-Hwan Ahn, and Nack-Joon Kim), issued Oct. 28, 1986 on an application filed Nov. 29, 1984, as a continuation-in-part of an application filed on Aug. 6, 1984
- U.S. Pat. No. 4,671,827 (Gareth Thomas, Nack J. Kim, and Ramamoorthy Ramesh), issued Jun. 9, 1987 on an application filed on Oct. 11, 1985
- U.S. Pat. No. 6,273,968 B1 (Gareth Thomas), issued Aug. 14, 2001 on an application filed on Mar. 28, 2000
- U.S. Pat. No. 6,709,534 B1 (Grzegorz J. Kusinski, David Pollack, and Gareth Thomas), issued Mar. 23, 2004 on an application filed on Dec. 14, 2001
- U.S. Pat. No. 6,746,548 (Grzegorz J. Kusinski, David Pollack, and Gareth Thomas), issued Jun. 8, 2004 on an application filed on Dec. 14, 2001
- WO 2004/046400 A1 (MMFX Technologies Corporation; Grzegorz J. Kusinski and Gareth Thomas, inventors), published Jun. 3, 2004

The microstructure plays a key role in establishing the properties of a particular steel alloy, the strength and toughness of the alloy depending not only on the selection and amounts of the alloying elements, but also on the crystalline phases present and their arrangement in the microstructure. Alloys intended for use in certain environments require higher strength and toughness, while others require ductility as well. Often, the optimal combination of properties includes properties in conflict with each other, since certain alloying elements, microstructural features, or both that contribute to one property may detract from another.

The alloys disclosed in the documents listed above are carbon steel alloys that have microstructures consisting of laths of martensite alternating with thin films of austenite. In some cases, the martensite is dispersed with carbide precipitates produced by autotempering. The arrangement in which laths of martensite are separated by thin films of austenite is referred to as a "dislocated lath" or simply "lath" structure, and is formed by first heating the alloy into the austenite range, then cooling the alloy below the martensite start temperature $M_s$, which is the temperature at which the martensite phase first begins to form. This final cooling brings the alloy into a temperature range in which the austenite transforms into the martensite-austenite lath structure, and is accompanied by standard metallurgical processing, such as casting, heat treatment, rolling, and forging, to achieve the desired shape of the product and to refine the lath structure as an alternating lath and thin-film arrangement. This lath structure is preferable to a twinned martensite structure, since the alternating lath and thin-film structure has greater toughness. The patents also disclose that excess carbon in the martensite regions of the structure precipitates during the cooling process to form cementite (iron carbide, $Fe_3C$). This precipitation is known as "autotempering." The '968 patent discloses that autotempering can be avoided by limiting the choice of the alloying elements such that the martensite start temperature $M_s$ is 350° C. or greater. In certain alloys the carbides produced by autotempering add to the toughness of the steel while in others the carbides limit the toughness.

The lath structure produces a high-strength steel that is both tough and ductile, qualities that are needed for resistance to crack propagation and for sufficient formability to permit the successful fabrication of engineering components from the steel. Controlling the martensite phase to achieve a lath structure rather than a twinned structure is one of the most effective means of achieving the necessary levels of strength and toughness, while the thin films of retained austenite contribute to the ductility and formability of the steel. Obtaining the lath microstructure without the twinned structure is achieved by a careful selection of the alloy composition, which in turn affects the value of $M_s$, and by controlled cooling protocols.

Another factor affecting the strength and toughness of the steel is the presence of dissolved gases. Hydrogen gas in particular is known to cause embrittlement as well as a reduction in ductility and load-bearing capacity. Cracking and catastrophic brittle failures have been known to occur at stresses below the yield stress of the steel, particularly in line-pipe steels and structural steels. The hydrogen tends to diffuse along the grain boundaries of the steel and to combine with the carbon in the steel to form methane gas. The gas collects in small voids at the grain boundaries where it builds up pressures that initiate cracks. One of the methods by which hydrogen is removed from the steel during processing is vacuum degassing, which is typically done on the steel in molten form at pressures ranging from about 1 torr to about 150 torr. In certain applications, such as steels produced in mini-mills, operations involving electric arc furnaces, and operations involving ladle metallurgy stations, vacuum degassing of molten steel is not economical, and either a limited vacuum or no vacuum is used. In these applications, the hydrogen is removed by a baking heat treatment. Typical conditions for the treatment are a temperature of 300–700° C. and a heating time of several hours such as twelve hours. This removes the dissolved hydrogen, but unfortunately it also causes carbide precipitation. Since carbide precipitation is the result of the expulsion of carbon from phases that are supersaturated with carbon, the precipitation occurs at the interfaces between the different phases or between the grains. Precipitates at these locations lower the ductility of the steel and provide sites where corrosion is readily initiated.

In many cases, carbide precipitation is very difficult to avoid, particularly since the formation of multi-phase steel necessarily involves phase transformations by heating or cooling, and the saturation level of carbon in a particular phase varies from one phase to the next. Thus, low ductility and susceptibility to corrosion are often problems that are not readily controllable.

SUMMARY OF THE INVENTION

It has now been discovered that strong, ductile, corrosion-resistant carbon steels and alloy steels with a reduced risk of failure due to carbide precipitates are manufactured by a process that includes the formation of a combination of ferrite regions and martensite-austenite lath regions (regions containing laths of martensite alternating with thin films of austenite), with nucleation sites within the ferrite regions for carbide precipitation. The nucleation sites direct the carbide precipitation to the interiors of the ferrite regions and thereby disfavor precipitation at phase or grain boundaries. The process begins with the formation of a substantially martensite-free austenite phase or a combination of martensite-free austenite and ferrite as separate phases. The process then proceeds with cooling of the austenite phase to convert a portion of the austenite to ferrite while allowing carbides to precipitate in the bulk of the newly formed ferrite. This newly formed ferrite phase which contains small carbide precipitates at sites other than the phase boundaries is termed "lower bainite." The resulting combined phases (austenite, lower bainite, and in some cases ferrite) are then cooled to a temperature below the martensite start temperature to transform the austenite phase to a lath structure of martensite and austenite. The final result is therefore a microstructure that contains a combination of the lath structure and lower bainite, or a combination of the lath structure, lower bainite, and (carbide-free) ferrite, and can be achieved either by continuous cooling or by cooling combined with heat treatments. The carbide precipitates formed during the formation of the lower bainite protect the microstructure from undesired carbide precipitation at phase boundaries and grain boundaries during subsequent cooling and any further thermal processing. This invention resides both in the process and in the multi-phase alloys produced by the process. Analogous effects will result from allowing nitrides, carbonitrides, and other precipitates to form in the bulk of the ferrite region where they will serve as nucleation sites that will prevent precipitation of further amounts of these species at the phase and grain boundaries.

These and other features, objects, advantages, and embodiments of the invention will be better understood from the descriptions that follow.

DETAILED DESCRIPTION OF THE INVENTION AND PREFERRED EMBODIMENTS

Figure 1:
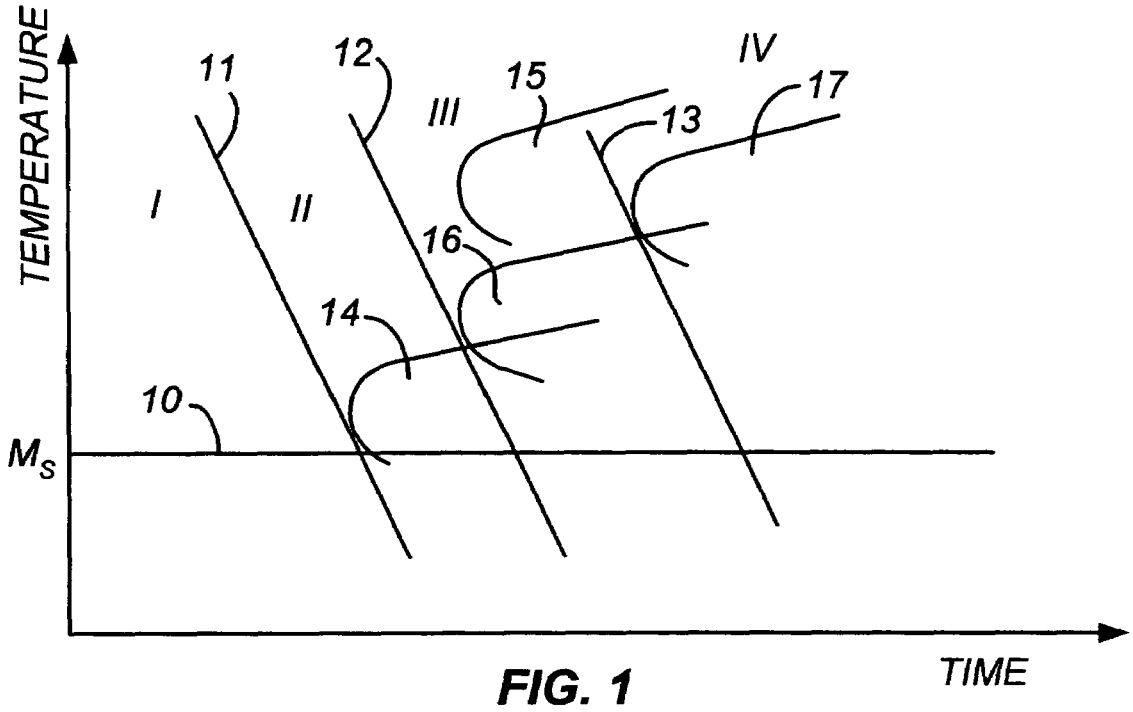
FIG. 1 is a schematic kinetic transformation-temperature-time diagram for a steel alloy within the scope of the present invention.

The term "carbide precipitates" refers to clusters or phases of compounds of carbon, primarily $Fe_3C$ (cementite) and $M_xC_y$ in general (where "M" represents a metallic element and the values of "x" and "y" depend on the metallic element) that are separate phases independent of the crystal lattices of the austenite, martensite and ferrite phases. When carbide precipitates are present in the bulk ferrite phase, the precipitates are surrounded by ferrite but are not part of the ferrite lattice. Expressions stating that there are "substantially no carbide precipitates" at phase boundaries or at other boundaries means that if any carbide precipitates are present at all at these boundaries, the amount of such precipitates is so small that it does not contribute significantly to the susceptibility of the alloy to corrosion or adversely affect the ductility of the alloy. The term "carbide-free" is used herein to indicate an absence of carbide precipitates but not necessarily an absence of carbon atoms.

Crystal phases that consist of ferrite with small carbide precipitates dispersed through the bulk of the ferrite but not at the phase boundaries are also referred to herein as "lower bainite." The carbide precipitates in these lower bainite phases are preferably of such a size that the longest dimension of the typical precipitate is about 150 nm or less, and most preferably from about 50 nm to about 150 nm. The term "longest dimension" denotes the longest linear dimension of the precipitate. For precipitates that are approximately spherical, for example, the longest dimension is the diameter, whereas for precipitates that are rectangular or elongated in shape, the longest dimension is the length of the longest side or, depending on the shape, the diagonal. Lower bainite is to be distinguished from "upper bainite" which refers to ferrite with carbide precipitates that are generally larger in size than those of lower bainite and that reside at grain boundaries and at phase boundaries rather than (or in addition to) those that reside in the bulk of the ferrite. The term "phase boundaries" is used herein to refer to interfaces between regions of dissimilar phases, and includes interfaces between martensite laths and austenite thin films as well as interfaces between martensite-austenite regions and ferrite regions or between martensite-austenite regions and lower bainite regions. Upper bainite is formed at lower cooling rates than those by which lower bainite is formed and at higher temperatures. The present invention seeks to avoid microstructures that contain upper bainite.

The alloy compositions used in the practice of this invention are those having a martensite start temperature $M_s$ of about 330° C. or higher, and preferably 350° C. or higher. While alloying elements in general affect the $M_s$, the alloying element that has the strongest influence on the $M_s$ is carbon, and limiting the $M_s$ to the desired range is generally achieved by limiting the carbon content of the alloy to a maximum of 0.35%. In preferred embodiments of the invention, the carbon content is within the range of from about 0.03% to about 0.35%, and in more preferred embodiments, the range is from about 0.05% to about 0.33%, all by weight.

As noted above, this invention is applicable to both carbon steels and alloy steels. The term "carbon steels" as used in the art typically refers to steels whose total alloying element content does not exceed 2%, while the term "alloy steels" typically refers to steels with higher total contents of alloying elements. In preferred alloy compositions of this invention, chromium is included at a content of at least about 1.0%, and preferably from about 1.0% to about 11.0%.

Manganese may also be present in certain alloys within the scope of this invention, and when manganese is present, its content is at most about 2.5%. Another alloying element which may also be present in certain alloys within the scope of this invention is silicon, which when present will preferably amount to from about 0.1% to about 3%. Examples of other alloying elements included in various embodiments of the invention are nickel, cobalt, aluminum, and nitrogen, either singly or in combinations. Microalloying elements, such as molybdenum, niobium, titanium, and vanadium, may also be present. All percents in this paragraph are by weight.

Both the intermediate microstructure and the final microstructure of this invention contain a minimum of two types of spatially and crystallographically distinct regions. In certain embodiments, the two regions in the intermediate structure are lower bainite (ferrite with small carbide precipitates dispersed through the bulk of the ferrite) and austenite, and in the final structure the two regions are lower bainite and martensite-austenite lath regions. In certain other embodiments, a preliminary structure is first formed prior to the bainite formation, the preliminary structure containing ferrite grains (that are carbide-free) and austenite grains (that are both martensite-free and carbide-free). This preliminary structure is then cooled to achieve first the intermediate structure (containing ferrite, lower bainite and austenite) and then the final structure. In the final structure, the carbide-free ferrite grains and the lower bainite regions are retained while the remaining martensite-free and carbide-free austenite grains are transformed into the martensite-and-retained-austenite (alternating lath and thin film) structure and grains of lower bainite.

In each of these structures, the grains, regions and different phases form a continuous mass. The individual grain size is not critical and can vary widely. For best results, the grain sizes will generally have diameters (or other characteristic linear dimension) that fall within the range of about 2 microns to about 100 microns, or preferably within the range of about 5 microns to about 30 microns. In the final structure in which the austenite grains have been converted to martensite-austenite lath structures, the martensite laths are generally from about 0.01 micron to about 0.3 micron in width, preferably from about 0.05 micron to about 0.2 micron, and the thin austenite films that separate the martensite laths are generally smaller in width than the martensite laths. The lower bainite grains can also vary widely in content relative to the austenite or martensite-austenite phase, and the relative amounts are not critical to the invention. In most cases, however, best results will be obtained when the austenite or martensite-austenite grains constitute from about 5% to about 95% of the microstructure, preferably from about 15% to about 60%, and most preferably from about 20% to about 40%. The percents in this paragraph are by volume rather than weight.

While this invention extends to alloys having the microstructures described above regardless of the particular metallurgical processing steps used to achieve the microstructure, certain processing procedures are preferred. For certain microstructures, the procedures begin by combining the appropriate components needed to form an alloy of the desired composition, then homogenizing ("soaking") the composition for a sufficient period of time and at a sufficient temperature to achieve a uniform, substantially martensite-free austenitic structure with all elements and components in solid solution. The temperature will be one that is above the austenite recrystallization temperature, which may vary with the alloy composition. In general, however, the appropriate temperature will be readily apparent to those skilled in the art. In most cases, best results will be achieved by soaking at a temperature within the range of 850° C. to 1200° C., and preferably from 900° C. to 1100° C. Rolling, forging or both are optionally performed on the alloy at this temperature.

Once the austenite phase is formed, the alloy composition is cooled to a temperature in an intermediate region, still above the martensite start temperature, at a rate that will cause a portion of the austenite to transform to lower bainite, leaving the remainder as austenite. The relative amounts of each of the two phases will vary with both the temperature to which the composition is cooled and the levels of the alloying elements. As noted above, the relative amounts of the two phases are not critical to the invention and can vary, with certain ranges being preferred.

The transformation of austenite to lower bainite prior to cooling into the martensite region is controlled by the cooling rate, i.e., the temperature to which the austenite is lowered, the length of time over which the temperature drop is extended, and the length of time in which the composition is allowed to remain at any given temperature along the cooling path in the plot of temperature vs. time. As the length of time that the alloy is held at relatively high temperatures is extended, ferrite regions tend to form, first with no carbides, and then with high levels of carbides to result in carbide-containing ferrite phases that are termed pearlite and upper bainite with carbides at phase interfaces. Both pearlite and upper bainite are preferably avoided, and thus the transformation of a portion of the austenite is achieved by cooling quickly enough that the austenite is transformed either to simple ferrite or to lower bainite (ferrite with small carbides dispersed within the bulk of the ferrite). The cooling that follows either of these transformations is then performed at a rate high enough to again avoid the formation of pearlite and upper bainite.

In certain embodiments of this invention, as noted above, the final structure includes simple ferrite grains in addition to the lower bainite and martensite-austenite lath structure regions. An early stage in the formation of this final structure is one in which the austenite phase coexists with the simple ferrite phase. This stage can be achieved in either of two ways—by either soaking to produce full austenitization followed by cooling to transform some of the austenite to simple ferrite, or by forming the austenite-ferrite combination directly by controlled heating of the alloy components. In either case, this preliminary stage once formed is then cooled to transform a portion of the austenite to lower bainite, with essentially no change to the regions of simple ferrite. This is then followed by further cooling at a rate high enough to simply convert the austenite to the lath structure with substantially no further transformation in either the simple ferrite or the lower bainite regions. This is achieved by passing through the time-temperature region where a portion of the austenite is transformed into lower bainite, and then to the region where the remaining austenite is transformed into the lath structure. When protocols are followed that do not involve the preliminary formation of simple (carbide-free) ferrite regions, the result is a final microstructure that includes lower bainite regions and regions of the martensite-austenite lath structure, with no simple ferrite regions and no carbide precipitates at any of the boundaries between the various regions. When protocols are followed that do include the preliminary formation of simple ferrite regions, the result is a final microstructure that includes simple ferrite regions, lower bainite regions, and regions of the martensite-austenite lath structure, again with no carbide precipitates at any of the boundaries between the various regions.

The term "contiguous" is used herein to describe regions that share a boundary. In many cases, the shared boundary is planar or at least has an elongated, relatively flat contour. The rolling and forging steps cited in the preceding paragraph tend to form boundaries that are planar or at least elongated and relatively flat. "Contiguous" regions in these cases are thus elongated and substantially planar.

The appropriate cooling rates needed to form the carbide precipitate-containing ferrite phase and to avoid the formation of pearlite and upper bainite (ferrite with relatively large carbide precipitates at the phase boundaries) are evident from the kinetic transformation-temperature-time diagram for each alloy. The vertical axis of the diagram represents temperature and the horizontal axis represents time, and curves on the diagram indicate the regions where each phase exists either by itself or in combination with one or more other phases. These diagrams are well known in the art and readily available in the published literature. A typical such diagram is shown in Thomas, U.S. Pat. No. 6,273,968 B1, referenced above. Two further diagrams are shown in FIGS. 1 and 2.

Figure 2:
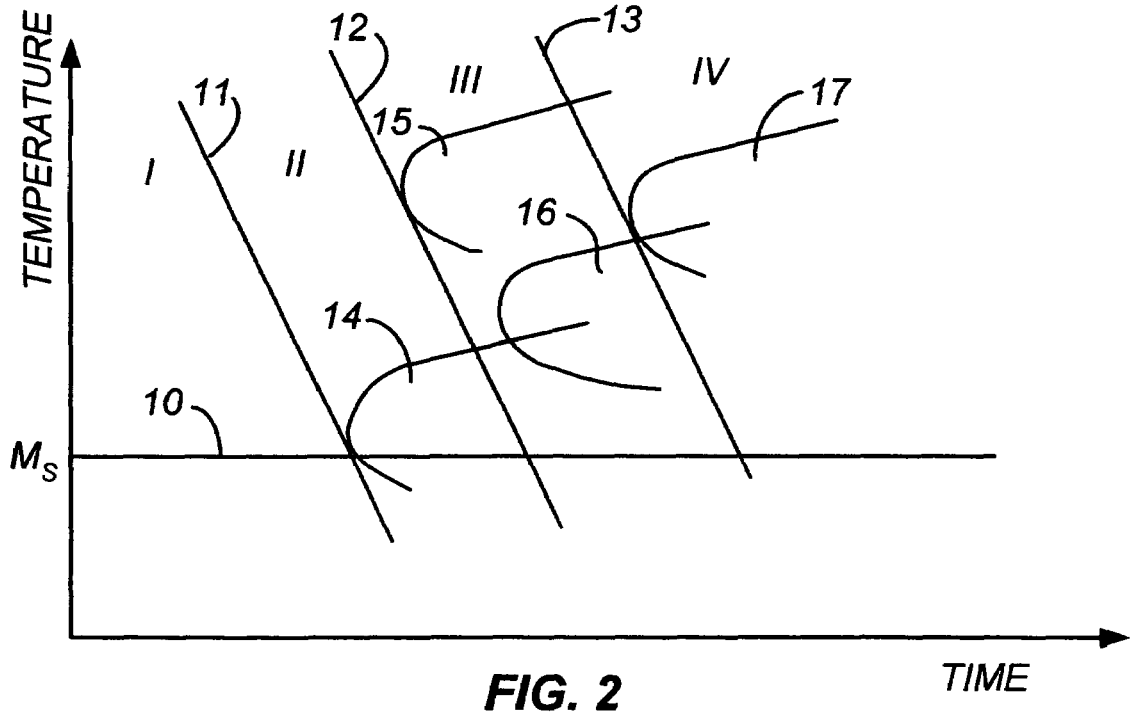
FIG. 2 is a schematic kinetic transformation-temperature-time diagram for a second steel alloy, different from that of FIG. 1 but still within the scope of the present invention.

FIGS. 1 and 2 are kinetic transformation-temperature-time diagrams for two alloys that are chosen to illustrate the invention. The regions of temperature and time in which different phases are formed are indicated in these diagrams by the curved lines which are the boundaries of the regions indicating where each phase first begins to form. In both Figures, the martensite start temperature $M_s$ is indicated by the horizontal line 10, and cooling from above the line to below the line will result in the transformation of austenite to martensite. The region that is outside (on the convex sides) of all of the curves and above the $M_s$ line in both diagrams represents the all-austenite phase. The locations of the boundary lines for each of the phases shown in the diagrams will vary with the alloy composition. In some cases, a small variation in a single element will shift one of the regions a significant distance to the left or right, or up or down. Certain variations will cause one or more regions to disappear entirely. Thus, for example, a 2% variation in the chromium content or a similar variation in the manganese content can cause a difference similar to that between the two Figures. For convenience, each diagram is divided into four regions I, II, III, IV, separated by slanted lines 11, 12, 13. The phase regions delineated by the curves are a lower bainite region 14, a simple (carbide-free) ferrite region 15, an upper bainite region 16, and a pearlite region 17.

In the alloys of both FIGS. 1 and 2, if the initial stage of the process is full austenization and the cooling path subsequent to full austenitization is maintained within the region of the diagram designated by the Roman numeral I, the cooling protocol will produce the martensite-austenite lath structure (laths of martensite alternating with thin films of austenite) exclusively. In both cases as well, if the cooling protocol remains within the region designated by the Roman numeral II, i.e., between the first back-slanted line 11 and the second back-slanted line 12, the alloy will pass through the lower bainite region 14 in which a portion of the austenite phase will transform into a lower bainite phase (i.e., a ferrite phase containing small carbides dispersed through the bulk of the ferrite) coexisting with the remaining austenite. As cooling continues past $M_s$, this lower bainite phase will remain while the remaining austenite is transformed into the martensite-austenite lath structure. The result is a four-phase microstructure in accordance with the present invention.

If cooling from the initial all-austenite condition is performed at a slower rate in either alloy, the cooling path will enter the region designated as Roman numeral III. In the alloy of FIG. 1, a cooling rate that is sufficiently slow will follow a cooling path that enters the simple ferrite region 15 in which some of the austenite is converted to simple (carbide-free) ferrite grains that coexist with the remaining austenite. Because of the locations of the various regions in FIG. 1, once the simple ferrite grains have been formed by cooling through the simple ferrite region 15, the alloy upon further cooling will pass through the upper bainite region 16 in which large carbide precipitates form at inter-phase boundaries. With this particular alloy, this can only be avoided by a cooling rate that is fast enough to avoid both the simple ferrite region 15 and the upper bainite region 16. Final cooling past $M_s$ transforms the remaining austenite into the martensite-austenite lath structure.

In the alloy of FIG. 2, the locations of the simple ferrite phase 15 and the lower bainite phase 16 are shifted relative to each other. In this alloy, unlike that of FIG. 1, the "nose" or leftmost extremity of the simple ferrite region 15 is to the left of the "nose" of the upper bainite region 16, and thus a cooling path can be devised that will allow simple ferrite grains to form without also forming upper bainite upon further cooling to temperatures below the martensite start temperature. In the alloys of both Figures, pearlite will be formed if the alloys are held at intermediate temperatures long enough to cause the cooling path to traverse the pearlite region 17. The further that the cooling curve remains from the pearlite 17 and upper bainite 16 regions, the less likelihood that carbide precipitates will form at regions other than within the bulk of the ferrite phases, i.e., at regions other than those occurring in region 14 of the diagram. Again, it is emphasized that the locations of the curves in these diagrams are illustrative only. The locations can be varied further with further variations in the alloy composition. In any case, microstructures with simple ferrite regions and lower bainite regions but no upper bainite can only be formed if the simple ferrite region 15 can be reached earlier in time than the upper bainite region 16. This is true in the alloy of FIG. 2 but not in the alloy of FIG. 1.

Figure 3:
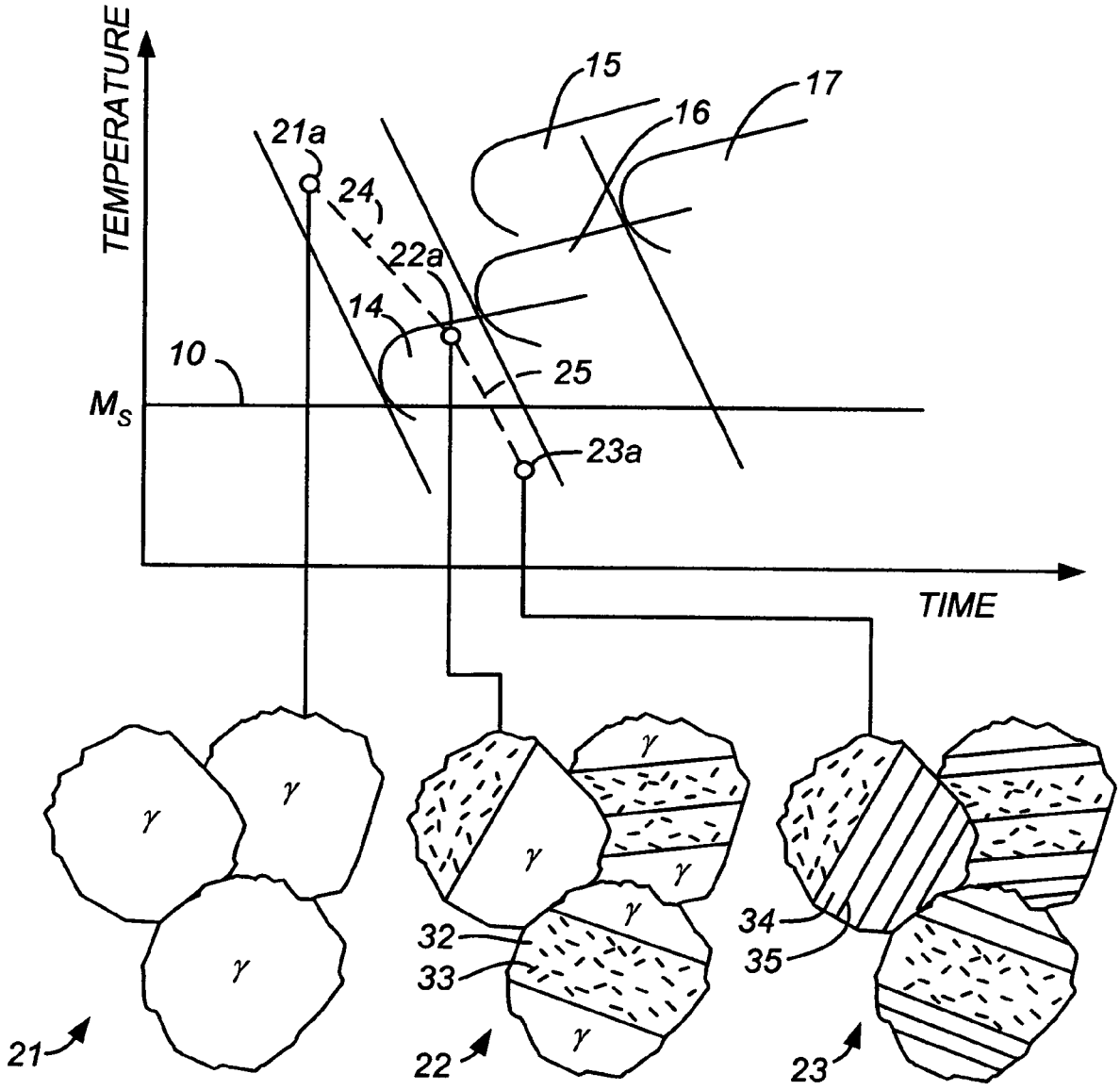
FIG. 3 is a representation of a cooling protocol within the scope of the invention and the stages of the resulting microstructure, for the alloy of FIG. 1.
Figure 4:
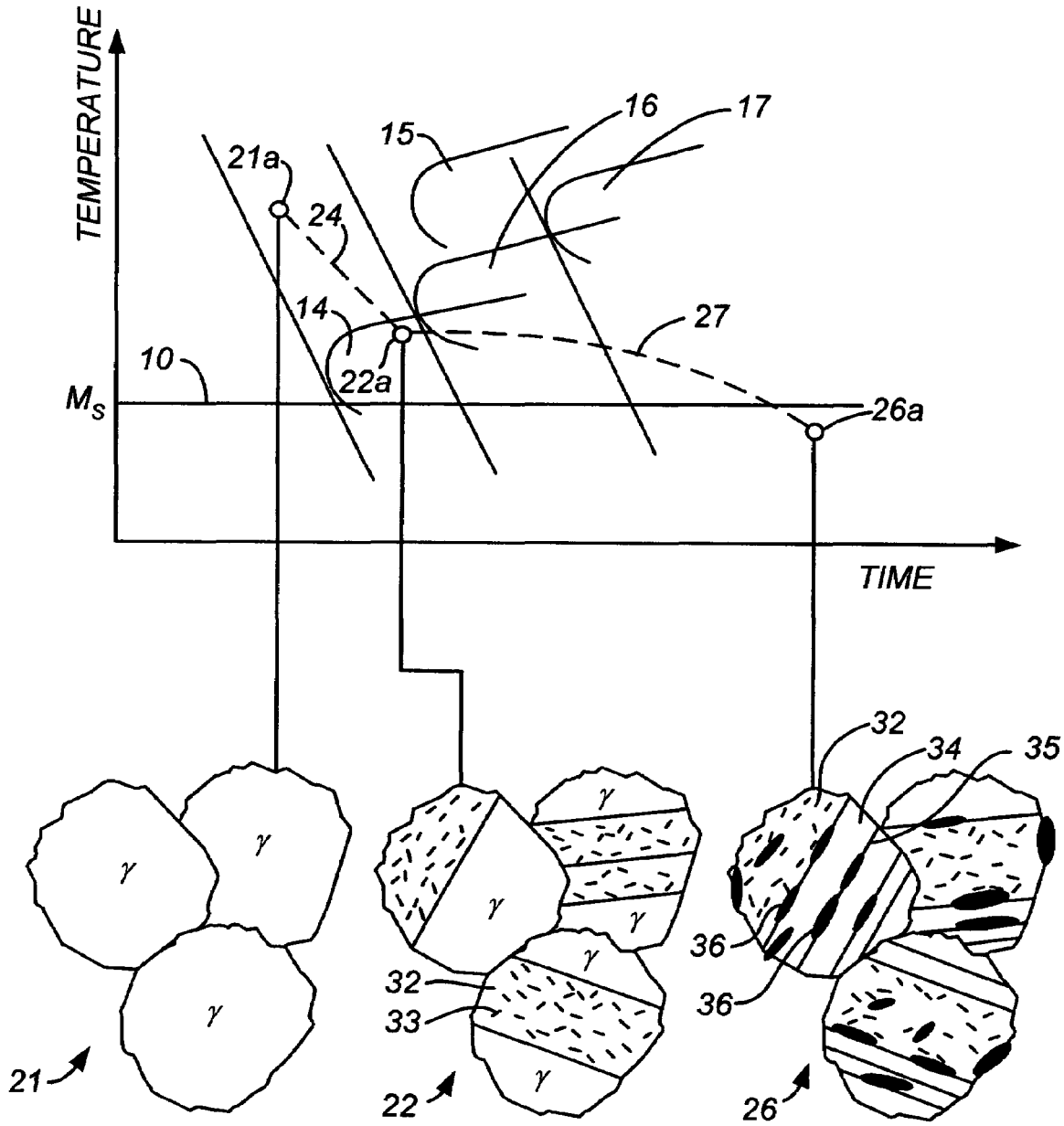
FIG. 4 is a representation of a different cooling protocol, and corresponding microstructure stages, for the alloy of FIG. 1, outside the scope of the invention.
Figure 5:
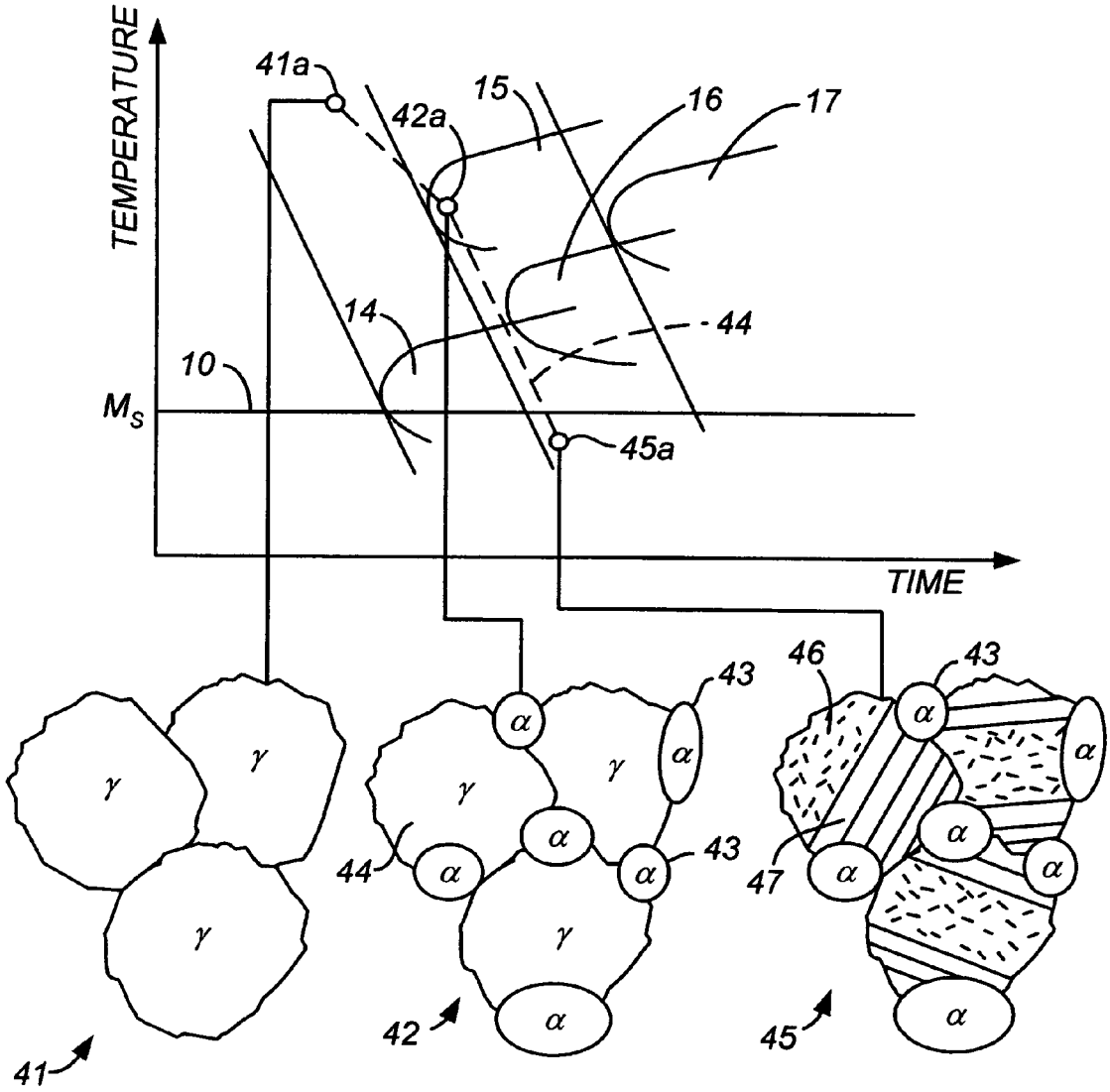
FIG. 5 is a representation of a cooling protocol within the scope of the invention and the stages of the resulting microstructure, for the alloy of FIG. 2.
Figure 6:
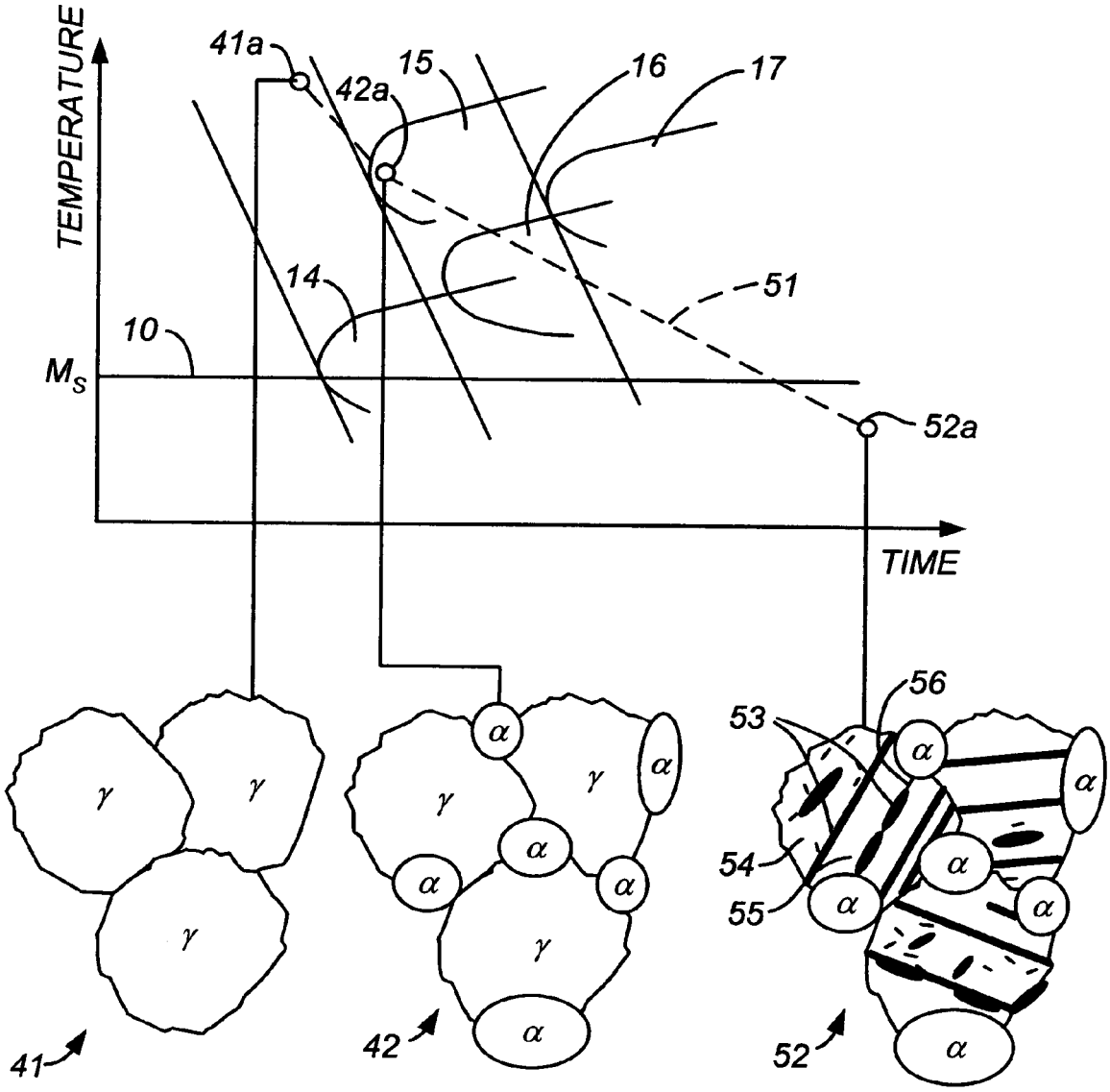
FIG. 6 likewise represents the alloy of FIG. 2 but with a cooling protocol and corresponding microstructure stages that are outside the scope of the invention.

Individual cooling protocols are demonstrated in the succeeding figures. FIGS. 3 and 4 illustrate protocols performed on the alloy of FIG. 1, while FIGS. 5 and 6 illustrate protocols performed on the alloy of FIG. 2. In each case, the transformation-temperature-time diagram of the alloy is reproduced in the upper portion of each Figure and the microstructures at different points along the cooling path are shown in the lower portion.

In FIG. 3 (which applies to the alloy of FIG. 1), a cooling protocol is shown in two steps beginning with the all-austenite (y) stage 21 represented by the coordinates at the point 21*a* in the diagram, continuing to the intermediate stage 22 represented by the coordinates at the point 22*a* in the diagram, and finally to the final stage 23 represented by the coordinates at the point 23*a* in the diagram. The cooling rate from the all-austenite stage 21 to the intermediate stage 22 is indicated by the dashed line 24, and the cooling rate from the intermediate stage 22 to the final stage 23 is indicated by the dashed line 25. The intermediate stage 22 consists of austenite (y) 31 contiguous with regions of lower bainite (ferrite 32 with carbide precipitates 33 within the bulk of the ferrite). In the final stage 23, the austenite regions have been transformed to the martensite-austenite lath structure consisting of martensite laths 34 alternating with thin films of retained austenite 35.

The cooling protocol of FIG. 4 differs from that of FIG. 3 and is outside the scope of the invention. The difference between these protocols is that the final stage 26 of the protocol of FIG. 4 and its corresponding point 26*a* in the diagram were reached by passing through the route indicated by the dashed line 27 which passes through the upper bainite region 16. As noted above, upper bainite contains carbide precipitates 36 at grain boundaries and phase boundaries. These inter-phase precipitates are detrimental to the corrosion and ductility properties of the alloy.

FIGS. 5 and 6 likewise represent two different cooling protocols, but as applied to the alloy of FIG. 2. The cooling protocol of FIG. 5 begins in the all-austenite region and remains in that region until reaching a point 41*a* on the diagram where the microstructure remains all-austenite 41. Because of the relative locations of the simple ferrite 15 and upper bainite 16 regions, a cooling path can be chosen that will pass through the simple ferrite region 15 at an earlier point in time than the alloy of FIG. 1, and also an earlier point in time than the earliest point at which upper bainite 16 will form. At point 42*a* on the diagram, some of the austenite has been transformed into simple ferrite, resulting in an intermediate microstructure 42 that contains both austenite (γ) 44 and simple ferrite (a) grains 43. With the relative positions of the phase regions in the transformation-temperature-time diagram of this alloy, cooling from this intermediate stage to a temperature below the martensite start temperature 10 can be performed at a rate fast enough to avoid passing through the upper bainite region 16. This cooling follows a path indicated by the dashed line 44, which first passes through the lower bainite region 14 to cause a portion of the austenite to convert to lower bainite 46, and then traverses the martensite start temperature to form the martensite-austenite lath structure 47. During these transformations, the regions of carbide-free ferrite 43 remain unchanged, but the final structure 45 contains simple ferrite regions 43 in addition to the martensite-austenite lath regions 47 and the lower bainite regions 46.

The cooling protocol of FIG. 6 differs from that of FIG. 5 and is outside the scope of the invention. The difference is that the cooling in the FIG. 6 protocol that follows the transformation into the intermediate stage 42 follows a path 51 that passes through the upper bainite region 16 before traversing the martensite start temperature 10 to form the final microstructure 52, 52*a*. In the upper bainite region 16, carbide precipitates 53 form at the phase boundaries. Like the final microstructure of FIG. 4, these inter-phase precipitates are detrimental to the corrosion and ductility properties of the alloy.

The following examples are offered for purposes of illustration only.

EXAMPLE 1

For a steel alloy containing 9% chromium, 1% manganese, and 0.08% carbon, cooling from the austenitic phase at a rate faster than about 5° C./sec will result in a martensite-austenite lath microstructure that contains no carbide precipitates. If a slower cooling rate is used, namely one within the range of about 1°/sec to about 0.15° C./sec, the resulting steel will have a microstructure containing regions of martensite laths alternating with thin films of austenite as well as lower bainite regions (ferrite grains with small carbide precipitates within the ferrite) but no carbide precipitates at the phase interfaces, and will therefore be within the scope of the present invention. If the cooling rate is lowered further to below about 0.1° C./sec, the resulting microstructure will contain fine pearlite (troostite) with carbide precipitates at the phase boundaries. Small amounts of these precipitates can be tolerated, but in preferred embodiments of this invention, their presence is minimal.

Alloys whose microstructures are developed in accordance with this example without entering the upper bainite or pearlite regions will generally have the following mechanical properties: yield strength, 90–120 ksi; tensile strength, 150–180 ksi; elongation, 7–20%.

EXAMPLE 2

For a steel alloy containing 4% chromium, 0.5% manganese, and 0.08% carbon, cooling from the austenitic phase at a rate faster than about 100° C./sec will result in a martensite-austenite lath microstructure that contains no carbide precipitates. If a slower cooling rate is used, namely one that is less than 100° C./sec but higher than 5° C./sec, the resulting steel will have a microstructure containing regions of martensite laths alternating with thin films of austenite as well as lower bainite regions (ferrite grains with small carbide precipitates within the ferrite) but no carbide precipitates at the phase interfaces, and will therefore be within the scope of the present invention. If the cooling rate is lowered further to a range of 5° C./sec to 0.2° C./sec, the resulting microstructure will contain upper bainite with carbide precipitates at the phase boundaries, thereby falling outside the scope of this invention. This can be avoided by using a slow cooling rate followed by a fast cooling rate. Fine pearlite (troostite) will be formed at cooling rates lower than 0.33° C./sec. Here as well, small amounts of fine pearlite can be tolerated, but in the preferred practice of this invention, only minimal amounts of pearlite at most are present.

Analogous results can be obtained with other steel alloy compositions. For example, an alloy containing 4% chromium, 0.6% manganese, and 0.25% carbon and prepared as above with avoidance of the formation of upper bainite will have a yield strength of 190–220 ksi, a tensile strength of 250–300 ksi, and an elongation of 7–20%, The foregoing is offered primarily for purposes of illustration. Further modifications and variations of the various parameters of the alloy composition and the processing procedures and conditions may be made that still embody the basic and novel concepts of this invention. These will readily occur to those skilled in the art and are included within the scope of this invention. In the claims hereto, the term "comprising" is used in a non-restrictive sense to mean "including" and not to mean that additional elements are necessarily excluded.

What is claimed is:

1. A process for manufacturing a high-strength, ductile, corrosion-resistant carbon steel, said process comprising:

(a) heating an alloy composition to a temperature sufficiently high to form a starting microstructure comprising a substantially martensite-free austenite phase, said alloy composition having a martensite start temperature of at least about 330° C. and consisting of iron and alloying elements comprising about 0.03% to about 0.35% carbon, about 1.0% to about 11.0% chromium, and at most about 2.0% manganese;

(b) cooling said starting microstructure under conditions causing conversion thereof to an intermediate microstructure of austenite, ferrite, and carbides, said intermediate microstructure comprising contiguous phases of austenite and ferrite with carbide precipitates dispersed in said ferrite phases and substantially no carbide precipitates at phase boundaries; and (c) cooling said intermediate microstructure under conditions causing conversion thereof to a final microstructure of martensite, austenite, ferrite, and carbides, said final microstructure comprising martensite-austenite regions consisting of laths of martensite alternating with thin films of austenite, ferrite regions contiguous with said martensite-austenite regions, and carbide precipitates dispersed in said ferrite regions, with substantially no carbide precipitates at interfaces between said martensite laths and said austenite thin films, or at interfaces between said ferrite regions and said martensite-austenite regions.

2. The process of claim 1 wherein said carbide precipitates have longest dimensions of about 150 nm or less.

3. The process of claim 1 wherein said carbide precipitates have longest dimensions of about 50 nm to about 150 nm.

4. The process of claim 1 wherein said starting microstructure further comprises a ferrite phase substantially devoid of carbide precipitates, and said intermediate and final microstructures each further comprise regions of substantially carbide-free ferrite.

5. The process of claim 1 wherein said starting microstructure consists of austenite.

6. The process of claim 1 wherein said alloy composition has a martensite start temperature of at least about 350° C.

7. The process of claim 1 wherein said starting microstructure is devoid of carbides.

8. The process of claim 1 wherein said alloying elements further comprise about 0.1% to about 3% silicon.

9. An alloy carbon steel consisting of iron and alloying elements comprising about 0.03% to about 0.35% carbon, about 1.0% to about 11.0% chromium, and at most about 2.5% manganese, said alloy carbon steel having a microstructure comprising martensite-austenite regions consisting of laths of martensite alternating with thin films of austenite, ferrite regions contiguous with said martensite-austenite regions, and carbide precipitates dispersed in said ferrite regions, with substantially no carbide precipitates at interfaces between said martensite laths and said austenite thin films, or at interfaces between said ferrite regions and said martensite-austenite regions.

10. The alloy carbon steel of claim 9 wherein said microstructure further comprises ferrite regions substantially devoid of carbide precipitates.

11. The carbon alloy steel of claim 9 wherein said martensite-austenite regions are substantially devoid of carbide precipitates.

12. The carbon alloy steel of claim 9 wherein said microstructure consists of martensite-austenite regions consisting of laths of martensite alternating with thin films of austenite, ferrite regions contiguous with said martensite-austenite regions, and carbide precipitates dispersed in said ferrite regions, with substantially no carbide precipitates at interfaces between said martensite laths and said austenite thin films, or at interfaces between said ferrite regions and said martensite-austenite regions.

13. The carbon alloy steel of claim 9 wherein said alloying elements further comprise about 0.1% to about 3% silicon.

14. The carbon alloy steel of claim 9 wherein said microstructure comprises grains of 10 microns or less in diameter, each grain comprising a martensite-austenite region and a ferrite region contiguous with said martensite-austenite region.

15. The carbon alloy steel of claim 9 wherein said carbide precipitates have longest dimensions of about 150 nm or less.

16. The carbon alloy steel of claim 9 wherein said carbide precipitates have longest dimensions of about 50 nm to about 150 nm.

* * * * *